United States Patent [19]

Sassak

[11] Patent Number: 4,973,284

[45] Date of Patent: Nov. 27, 1990

[54] COMBINATION FLYING DISC AND DOLL

[76] Inventor: Mark S. Sassak, 1340 Linden, Plymouth, Mich. 48170

[21] Appl. No.: 440,810

[22] Filed: Nov. 24, 1989

[51] Int. Cl.[5] ..... A63H 27/00

[52] U.S. Cl. ..... 446/48; 446/268

[58] Field of Search ..... 446/26, 27, 28, 46, 446/47, 48, 69, 72, 220, 221, 223, 226, 369, 372, 901, 208, 313, 489, 268; 273/424, 425

[56] References Cited

U.S. PATENT DOCUMENTS

| | | | |
|---|---|---|---|
| D. 209,763 | 1/1968 | Mueller | D21/85 |
| 1,557,637 | 10/1925 | Warner | 446/268 |
| 1,607,055 | 11/1926 | Cooper | 446/268 |
| 2,180,340 | 11/1939 | Eisler | 446/268 |
| 2,454,095 | 11/1948 | Sandlovich | 446/268 X |
| 2,506,932 | 5/1950 | McAfee | 273/425 |
| 2,621,010 | 12/1952 | White | 446/268 X |
| 2,690,339 | 9/1954 | Hall . | |
| 3,185,480 | 5/1965 | Weyman et al. | 273/424 X |
| 3,234,685 | 2/1966 | Harrowe | 446/221 X |
| 3,493,228 | 2/1970 | Hicks et al. | 446/220 X |
| 3,710,503 | 1/1973 | Rylands | 446/489 |
| 3,710,505 | 1/1973 | Linenfelser | 446/46 |
| 4,030,472 | 6/1977 | Watkins | 446/46 |
| 4,114,885 | 9/1978 | Morrow | 273/424 |
| 4,176,843 | 12/1979 | DeWitt, Jr. | 273/424 X |
| 4,246,720 | 1/1981 | Stone | 273/424 X |
| 4,253,672 | 3/1981 | Milzoff et al. | 273/424 |
| 4,262,911 | 4/1981 | Opresik et al. | 446/46 X |
| 4,290,226 | 9/1981 | Stauffer | 446/46 |
| 4,560,358 | 12/1985 | Adler | 446/46 |
| 4,819,947 | 4/1989 | Mackey | 273/424 X |
| 4,820,230 | 4/1989 | Richards | 446/48 |

FOREIGN PATENT DOCUMENTS

| | | | |
|---|---|---|---|
| 127984 | 1/1902 | Fed. Rep. of Germany | 446/268 |
| 2076342 | 12/1981 | United Kingdom | 446/268 |

*Primary Examiner*—Mickey Yu

*Attorney, Agent, or Firm*—Harness, Dickey & Pierce

[57] ABSTRACT

A soft, lightweight disc and doll combination capable of being used as a tossing toy or twirled around your finger. The disc is circular with an inner perimeter and an outer perimeter and contains a hole in its body. The doll is spherical and fits securely inside the inner perimeter of the disc.

17 Claims, 1 Drawing Sheet

COMBINATION FLYING DISC AND DOLL

BACKGROUND OF THE INVENTION

The present invention relates generally to circular flying disc toys, and more particularly to an improved circular flying disc which is soft and flexible and which contains a soft spherical-shaped doll in its center to give the disc a distinctive appearance and flight path when thrown.

Flying disc toys have gained recognition in the field of amusement devices Typical of these flying disc toys is the "Frisbee", which is a closed-figure flying disc made of a relatively rigid material, such as plastic, having a recessed undersurface so that when tossed into the air, the disc will fly in a rotating fashion. This disc is not suitable to indoor use or capable of receiving an insertable element in its center.

Flying disc toys have been discovered that were formed from a flexible material and capable of indoor use. However, these discs are all of a closed-figure construction and are thus not capable of receiving an insertable element in their center.

Flying disc toys have also been discovered that have an opening in their center. However, these discs are formed of a relatively rigid material, and these discs are not suitable for indoor use nor are they particularly adaptable for receiving an insertable element in the center.

SUMMARY OF THE INVENTION

It is an object of the present invention to provide a soft, flexible, lightweight flying disc capable of receiving a soft spherical-shaped doll in its center which can be thrown, containing the doll, and which will provide the invention with a distinctive and appealing appearance.

It is a further object of this invention to provide a flying disc and doll combination which is made of soft, flexible, lightweight material and is safe for use indoors and can be used by small children in complete safety.

It is a further object of this invention to provide a flying disc and doll combination where the doll will easily fit inside the center of the disc and will stay secure inside the disc when the disc is thrown.

It is a further object of this invention to provide a disc and doll combination that can be twirled around on a finger as well as thrown.

It is a further object of this invention to provide a flying disc and doll combination which are easily separated and can be used separately as a flying disc and a doll.

The flying disc of the present invention includes a circular body constructed of a soft, lightweight material. The circular body has a circular central opening and an upper surface and a lower surface, and there is a hole about the diameter of a finger in the body running from the upper surface to the lower surface. The upper and lower surfaces are covered with fabric which is sewn together at the inner perimeter, enclosing the central opening, and at the outer perimeter of the circular body. A soft, spherical-shaped doll constructed of a foam-like material is inserted into the central opening of the disc and is held in place by friction or by hook and loop fastener material sold under the trademark Velcro. The flying disc and doll combination can be used as one toy, with the doll secured inside the central opening of the disc, or the doll can be taken out of the disc and the two can be used separately.

BRIEF DESCRIPTION OF THE DRAWINGS

Additional benefits and advantages of the present invention will become apparent by reference to the following drawings depicting a preferred embodiment of the invention.

DESCRIPTION OF THE PREFERRED EMBODIMENT

Figure 3:
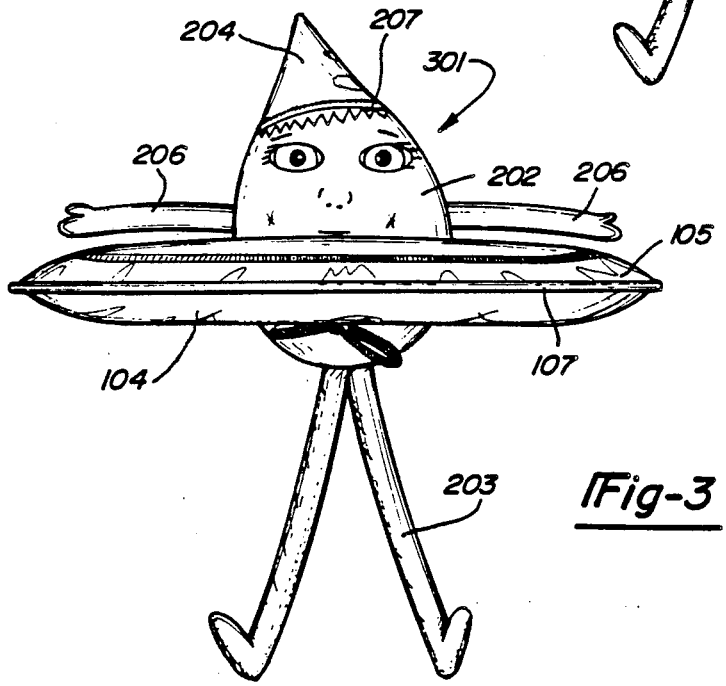
FIG. 3 is a perspective view of the inventive combination.

Referring now to the drawings, FIG. 3 depicts a typical combination flying disc and doll toy 301 comprised of a flying disc 101 made of a soft, lightweight material which has a circular central opening 102 and a spherical-shaped doll 201 made of a foam-like material which fits securely into the central opening 102 of the flying disc 101.

Figure 1:
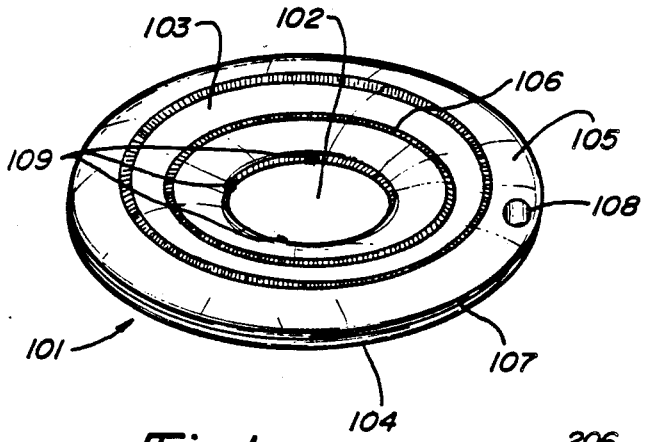
FIG. 1 is a top perspective view of the flying disc portion of the invention.

The flying disc portion 101 of the combination, as shown in FIG. 1, includes a circular body 105 having a circular central opening 102. The circular body 105 is constructed of a soft, lightweight cushionable material such as foam, fabric, or a fabric enclosing a fiber stuffing. The circular body has an upper surface 103 and a lower surface 104 which form an inner perimeter 106 which encloses the central opening 102 and an outer perimeter 107 which encloses the inner perimeter 106. The upper surface 103 and the lower surface 104 are curved from the inner perimeter 106 to the outer perimeter 107 and there- is a hole 108 with a diameter of about three-fourths of an inch in the circular body 105 running from the upper surface 103 to the lower surface 104. Fabric or any other suitable material can then be placed over the body 105 of the disc and be contained with nylon tape. This fabric can then be sewn or stitched together at the inner perimeter 106 and outer perimeter 107 of the disc. Hook and loop fasteners material 109 can be placed on the inner perimeter 106 of the disc and hook and loop fastener material 208 can also be added to the doll 201 on the arms 206 to further aid in securing the doll 201 to the disc 101.

The finished disc has an inner perimeter 106 with a diameter of about three inches and an outer perimeter 107 with a diameter of about nine inches. This disc is very soft and extremely light in weight, weighing approximately one ounce, and is especially safe for indoor use and use by children.

Figure 2:
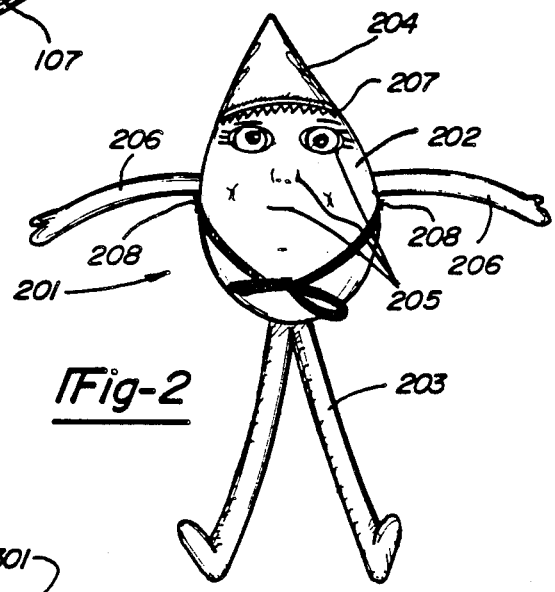
FIG. 2 is a perspective view of the doll portion of the invention.

The doll portion 201 of the combination, as shown in FIG. 2, includes a spherical body 202 made of a foam-like or a fabric enclosing a fiber, stuffing material. The doll 201 will fit securely into the circular central opening 102 of the flying disc 101 portion of the invention. This doll can have facial features 205 either drawn on the body 202 or attached to the body 202. The doll can also have legs 203 attached to the bottom of the body 202 which extend downward during the flight of the toy and arms 206 which extend outward during the flight of the toy. Hook and loop fasteners material 208 can be attached under the arms 206 to aid in securing the doll 201 inside the disc 101. The doll also has a hat 204 attached to the portion of the body 202 that will be extending upward during flight. Hair 207 made of a yarn-like material may also be attached under the hat 204.

The doll is soft and very light in weight, weighing only about two (2) ounces. Thus, the inventive combination 301 of the flying disc 101 and doll 201 is very soft and lightweight (weighing only about three ounces) and is very well suited for indoor use and for use by children.

It is to be understood that the above detailed description of embodiments of the invention are to be used for illustrative purposes only. Various details of design and construction may be modified without departing from the true spirit and scope of the invention as set forth in the appended claims.

What is claimed is:

1. An amusement device comprising:

a disc adapted for flight, said disc comprising a circular body constructed of a cushionable material, an upper surface and a lower surface, means forming a circular central opening and defining a circular inner perimeter enclosing said circular central opening, a circular outer perimeter enclosing said circular inner perimeter, and a removable doll having a spherical body constructed of a foam-like material or a fabric enclosing a fiber stuffing material; said body cooperating with said central opening of said disc by means for removably securing said doll to said disc.

2. The amusement device of claim 1 wherein said circular body is constructed of fabric.

3. The amusement device of claim 1 wherein said circular body is constructed of foam.

4. The amusement device of claim 1 wherein said circular body is constructed of a fiber stuffing and covered with fabric.

5. The amusement device of claim 1 wherein said upper surface and said lower surface are covered with fabric.

6. The amusement device of claim 5 including stitching means for connecting said fabric at said inner perimeter and said outer perimeter.

7. The amusement device of claim 1 wherein said means for securing said doll with said disc is friction.

8. The amusement device of claim 1 wherein said means for securing said doll with said disc is a hook and loop fastener material.

9. The amusement device of claim 1 wherein said doll further comprises facial features attached to one side of said spherical body.

10. The amusement device of claim 1 wherein said doll further comprises facial features drawn on one side of said spherical body.

11. The amusement device of claim 1 wherein said doll further comprises facial features stitched on one side of said spherical body.

12. The amusement device of claim 1 wherein said doll further comprises leg means attached to said spherical body which extend radially downward.

13. The amusement device of claim 12 including stitching means for connecting said leg means to said spherical body.

14. The amusement device of claim 12 wherein said doll further comprises a head covering means attached to said spherical body at the opposite end of said spherical body from said leg means.

15. The amusement device of claim 12 wherein said doll further comprises arm means attached to said spherical body which extend radially outward.

16. The amusement device of claim 1 wherein said circular body includes means forming an aperture between said inner perimeter and said outer perimeter which runs from said upper surface to said lower surface.

17. The amusement device of claim 14 which further comprises a yarn-like material under said head covering means which will extend outward during flight.

* * * * *